US006062420A

United States Patent [19]

Krouwel et al.

[11] Patent Number: 6,062,420

[45] Date of Patent: May 16, 2000

[54] APPARATUS FOR DISPENSING PILLS FROM A BLISTER PACK

[75] Inventors: Peter J. W. Krouwel; Marlies Van Dullemen, both of Leiden; Johannes H. Witte, Amsterdam; Erik W. Van der Hout, Leiden, all of Netherlands

[73] Assignee: NPK Industrial Design BV, Leiden, Netherlands

[21] Appl. No.: 09/029,019

[22] PCT Filed: Aug. 22, 1996

[86] PCT No.: PCT/NL96/00332

§ 371 Date: Jun. 3, 1998

§ 102(e) Date: Jun. 3, 1998

[87] PCT Pub. No.: WO97/08078

PCT Pub. Date: Mar. 6, 1997

[30] Foreign Application Priority Data

Aug. 23, 1995 [NL] Netherlands ..... 1001031

[51] Int. Cl.[7] ..... B65D 83/04

[52] U.S. Cl. ..... 221/5; 221/31; 221/88; 206/531; 206/534

[58] Field of Search ..... 221/74, 79, 81, 221/88, 25, 31, 5; 206/531, 532, 534, 534.2

[56] References Cited

U.S. PATENT DOCUMENTS 5,405,011 4/1995 Haber et al. ..... 221/88
5,464,118 11/1995 Grau et al. ..... 221/88

FOREIGN PATENT DOCUMENTS 0301672 2/1989 European Pat. Off. .

*Primary Examiner*—H. Grant Skaggs

[57] ABSTRACT

An apparatus for dispensing pills from a blister pack in which cavities containing pills are distributed, comprises a lower part for supporting the pack in a ring-shape and an upper part fitting onto the lower part and surrounding the blister pack together with the lower part. The lower part and/or upper part includes at least a passage opening with which a pill to be dispensed can be aligned. A push out element can be positioned in line with the various pills in the blister pack and the passage opening and is operable for pushing out the pill to be dispensed through the passage opening. The lower and upper parts are substantially ring-shaped and the push out element is positioned on the inner side of the ring and is moveable outwardly for the push out action.

7 Claims, 5 Drawing Sheets

APPARATUS FOR DISPENSING PILLS FROM A BLISTER PACK

The present invention relates to an apparatus for dispensing pills from a blister pack in accordance with the preamble of claim 1.

Such apparatus is for example known from WO 94/067-06. In this prior art apparatus, the lower part is a round disk and the upper part is a flat dome shaped cover rotatably positioned thereon. The push out means is cut out from the upper surface of the upper part in the shape of a spring tongue or finger and by pushing the tongue from above the respective pill is pushed out by an ejecting nose of the tongue downwardly through the foil of the blister pack and through the respective passage opening of the lower part of the apparatus. By rotating the upper part, the ejecting nose of the tongue-shaped push out means is positioned above the next pill and the correct position of the ejecting nose is determined by a snap lock. According to the description, the ejecting nose may be positioned above the pill only just before it is being pushed out, by rotating the upper part with respect to the lower part, since otherwise there is a risk that the pill is pushed out by accident, for example when the apparatus becomes wedged in a pocket or bag of the user.

It is an object of the invention to provide an apparatus of the type mentioned in the preamble, in which the risk of accidentally pushing out a pill is further reduced, also when the push out means is aligned with a pill to be dispensed.

To obtain this object, the apparatus according to the invention is characterised by the features of the characterising portion of claim 1.

According to the invention, the push out means is positioned on the inner side of the ring-shaped upper and lower parts, so that only a pressure from the inside can operate the push out means. It is very unlikely that such a movement takes place accidentally.

According to a preferred embodiment, an unintended operation of the push out means, particularly also by children, is prevented by using a locking means, which is moveable between operative and inoperative positions and which prevents an outward movement of the push out means in its operative position.

Still a further protection of the pills and the pack in the apparatus, in an embodiment which is intended for a substantially flat ring-shaped blister pack, which is positioned in the apparatus in a flat manner, is offered if the push out means is connected to the lower part, and the upper part comprises means to lock the blister pack in a rotationally fixed matter with respect thereto, and wherein the lower part preferably has only one passage opening for a number of passage openings corresponding to a number of pills to be pushed out simultaneously. Due to this assembly of parts, the pack moves with respect to the lower part of the apparatus, so that the lower part has to be provided with one passage opening only, contrary to the apparatus according to said WO 94/06706 for example, where there should be as many passage openings in the lower part as pills in the pack, which creates a certain risk that the pack is damaged through the passage openings and a pill is polluted or even lost from the pack.

An alternative embodiment of the apparatus according to the invention is intended for substantially flat rectangular blister packs which should be positioned in the apparatus in a ring shape with the openings of the cavities therein directed outwardly. Herein, the push out means is connected to the upper part and the lower part comprising means for locking the blister pack in a rotationally fixed manner with respect thereto, and wherein the upper part has preferably only one passage opening or a number of passage openings corresponding to the number of pills pushed out simultaneously.

A further improvement of the operation of the apparatus according to the invention is obtained when a part, preferably the lower part, substantially defines the inner side of the ring and the other part, preferably the upper part defines the outer side of the ring.

Due to this structure it is enabled to grab a part of the apparatus on the outer circumference and the other part on the lower and inner side, which allows an easy relative rotation of both parts. The apparatus can be operated with one hand only, particularly when the inner side of the ring is provided with a specially designed shape. It is for example possible that the push out means projects inwardly from the ring in an ergonomic way, in order to offer grip to one or more fingers.

A favourable embodiment of the apparatus according the invention is one in which, the push out means is slideable outwardly and comprises a ramp for pushing out a pill.

Due to the ramp of the push out means, the pill is pushed out through the cover foil of the blister pack in a gradual and reliable manner during the outward movement of the push out means.

For guiding the movement of the push out means, it may be received within a radially, outwardly extending guide so that the push out means makes a rectilinear movement, but it is also possible to have the push out means pivot about an axis parallel to the center line of the ring.

A very advanced embodiment of the apparatus according to the invention is one which is characterised by electronic means including a timer and a registration means for registrating the action of pushing out a pill from the pack.

This electronic means offers the possibility of monitoring the right time for taking a pill as a result of which the medicine can work effective. It is for example possible that the electronic means comprises an alarm which goes off if the registration means has not registered that a pill has been pushed out at a predetermined time. In this manner a user is warned if the pill should be taken. Another possibility is that the electronic means comprises a readable memory for storing the time at which each pill is pushed out. In this embodiment the therapy manager such as a doctor can determine the pill take behaviour of the user by means of the readable memory and can take action if necessary. The registration means may for example be a sensor which is able to sense a push out movement of the push out means and possibly also a rotational movement of the pack. Another possibility is that the passage of a pill through the passage opening is registered.

The invention will hereafter be further explained with reference to the drawing showing exemplary embodiments of the apparatus according to the invention.

FIGS. 2 and 3 are enlarged sectional views of the apparatus of FIG. 1 in the mounted position along the line II—II, wherein FIG. 2 illustrates the locked position, and FIG. 3 illustrates the push out position of the push out means.

Figure 1:
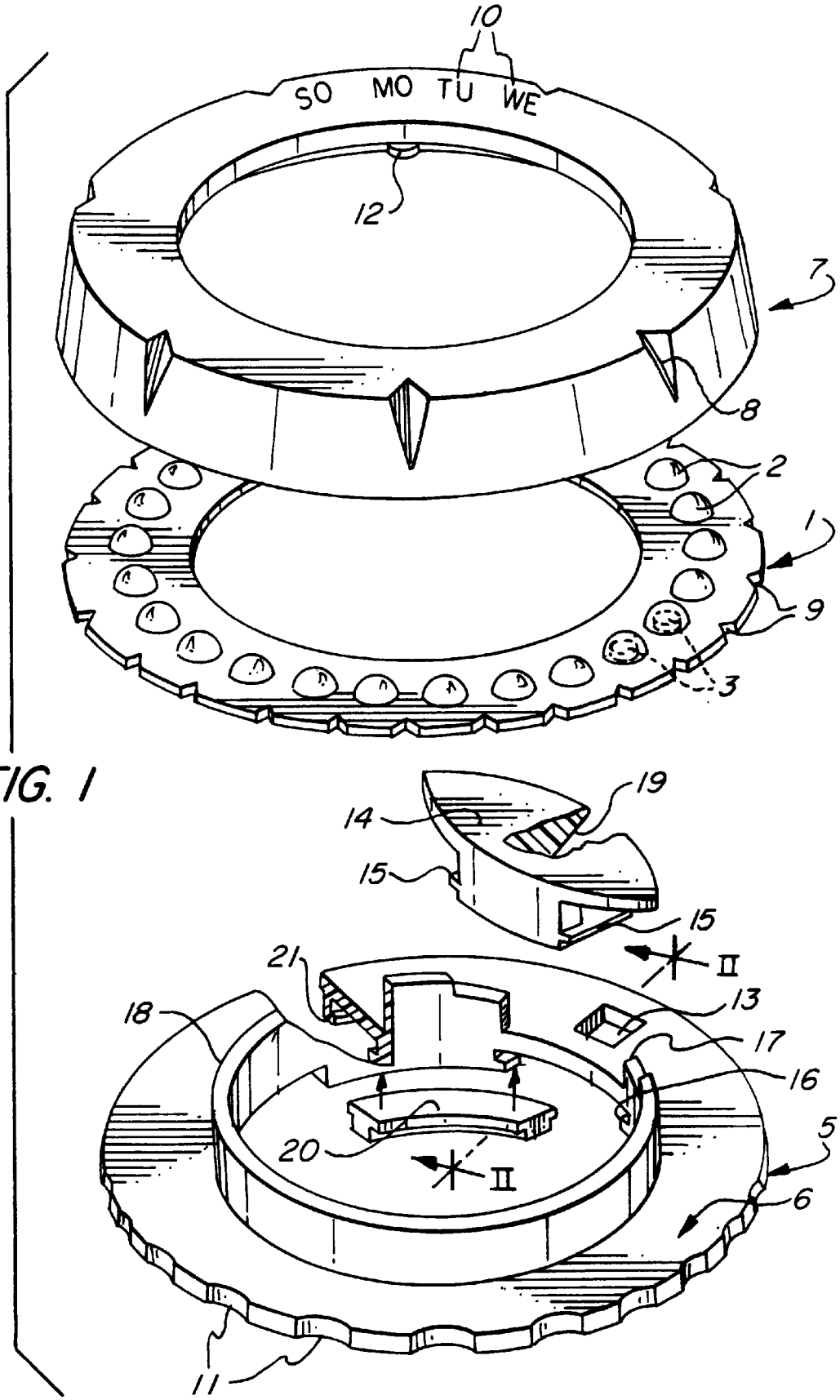
FIG. 1 is a perspective exploded view of a first embodiment of the apparatus according to the invention.
Figure 2:
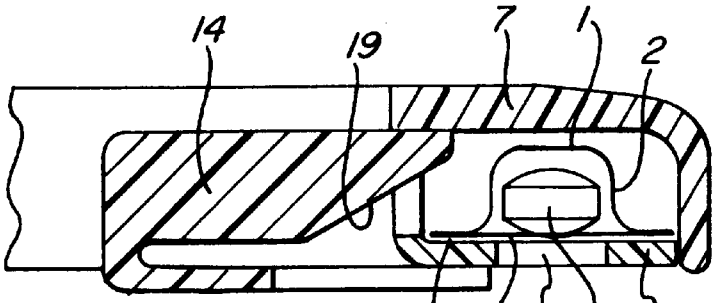
Figure 3:
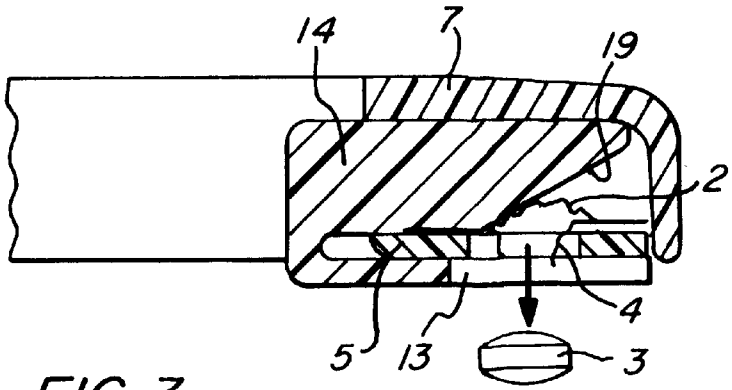

FIGS. 1–3 show a first embodiment of an apparatus for dispensing pills which are received in a blister pack 1. These pills should be taken within a certain time period, for example each day. The most well-known example of such pills are the contraceptives but all kinds of medicines may be stored and dispensed by means of the apparatus according to the invention.

The blister pack 1 consists of a flat, ring-shaped, transparent plastic body having cavities 2 distributed around the ring and each containing a pill 3. The cavities 2 having one open side are closed by a common cover foil 4 (FIG. 2–3) which may consist for example of a very thin metal foil and which is easily teared if a pill is pushed out of the cavity.

As FIG. 1 further illustrates, the apparatus according the invention comprises a ring-shaped lower part 5 having a ring-shaped face 6 for supporting the blister pack 1, as well as a ring-shaped upper part 7, which can be rotatably and removeably attached to the lower part 5 and covers the blister pack together with the lower part 5. The upper part 7 has on its circumference a plurality of depressions 8 forming thin rib shaped projections on the inner side which may engage recesses 9 in the outer circumference of the blister pack 1. These recesses are distributed in the same manner as the cavities 2 and ensure that when the blister pack 1 is positioned within the upper part 7 it is rotationally locked relative to the upper part 7. This locking causes the blister pack 1 to move with the upper part 7 when the upper part 7 is rotated relative to the lower part 5. In case the pills 3 in the blister pack 1 are not all the same and consequently certain pills should be taken in certain time periods, the blister pack 1 should be placed in a certain position relative to the upper part 7. In order to determine this position, the upper face of the transparent upper part 7 contains period indications 10, for example days of the week, which are provided with the same distribution as the cavities 2 in the blister pack 1 and should be aligned with the pill to be taken in that period.

To facilitate the rotation of the upper and lower parts 5, 7 relatively through an angle corresponding to the angular distance between two cavities 2 in the blister pack 1, the lower part 5 comprises a click-edge 11 having hollows in the same distribution as the cavities 2 in the blister pack 1 and in which a cam 12 on the inner wall of the upper part 7 may snap consecutively. The ring-shaped support face 6 of the lower part 5 comprises a passage opening 13 with which a cavity 2 in the blister pack 1 may be aligned consecutively in order to push out the respective pills 3 through the passage opening 13.

In order to push out a pill 3 from the blister pack 1 there is provided a push out means 14 in the form of a slide on the inner side of the ring shaped lower part 5 and at the position of the passage opening 13. This push out means 14 is guided by means of uprights 15 in a radial straight guide 16 on the lower side of the lower part 5 so that the push out means 14 may slide in radial direction relative to the lower part 5. For this purpose, there is also formed a break-through 17 in a ring shaped inner wall 18 of the lower part 5. To push out the pill 3 from the blister pack 1 by flattening the cavity 2, the push out means 14 comprises a ramp 19 extending in outward direction from the face 6 of the lower part 5. As is shown in FIGS. 2 and 3, the ramp 19 is positioned right above the cavity 2 when the push out means 14 is in the inward rest position, whereas an outward displacement of the push out means 14 causes the ramp 19 to be pushed onto the cavity 2 and as a result of the deformation of the cavity 2, the pill 3 is pushed outside through the tearing cover foil 4 and the passage opening 13. Not shown, but of course present are means for inwardly limiting the movement of the push out means 14 as well as spring means for inwardly loading the push out means 14 to the rest position, so that the push out means 14 automatically returns to the rest position after dispensing a pill 3.

In FIGS. 1 and 2, it is also shown that a locking member 20 in the form of a ring segment shaped slide is provided which is slideable in a ring segment shaped guide 21 on the lower side of the lower part 5 between a position outside the path of movement of the push out means 14 in order to release the push out means 14, and a locking position in the path of the push out means 14. In this locking position, the locking member 20 also covers the passage opening 13 on the lower side, so that not only the push out means 14 is prevented from moving accidentally to the push out position, but the passage opening 13 is also covered so that it is impossible that the pill 3 which is aligned with the passage opening 13 exits and pollution from outside enters the passage opening 13. The locking member 20 hinders the unauthorised operation of the push out means 14, for example by children. The locking member 20 may be spring loaded to the locking position, or may be arrested in both positions, by click or snap means.

The operation of the apparatus shown in FIGS. 1–3 herein before is simple and comfortable. For pushing out a pill, the lower and upper parts 5 and 7 should first be rotated relatively such that a sign (not shown) on the push out means 14 coincides with the indication 10 of the period in which a certain pill 3 should be taken. This rotation of the upper and lower parts may be effected by gripping the upper part 7 on the outer side and gripping the lower part 5 on the inner wall 18 and exerting a rotational force on the lower part 5, for example by pushing against the push out means 14. Then the locking member 20 is displaced to the releasing position, which locking member 20 can be reached through the guide 21 which is open on the lower side. Subsequently, the push out means 14 is pushed outwardly, for example by the thumb of a hand causing a pill 3 to be dispensed. By releasing the push out means 14 and moving the locking member 20 back, the apparatus is back in the initial position and ready to be used again in a next period. In the meantime the apparatus is closed in a safe way and is protected from accidental or un-authorised pushing out a pill.

Figure 5:
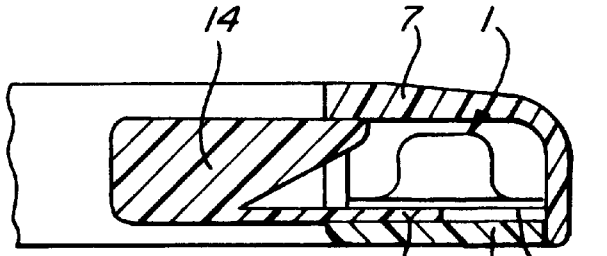
FIG. 5 is an enlarged section of view along the line V—V in FIG. 4.
Figure 4:
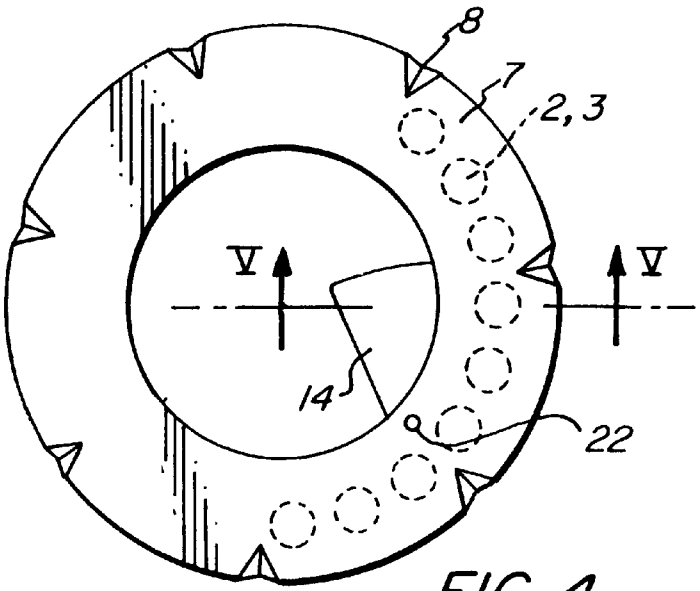
FIG. 4 is a plan view of a second exemplary embodiment of the apparatus according to the invention.
Figure 6:
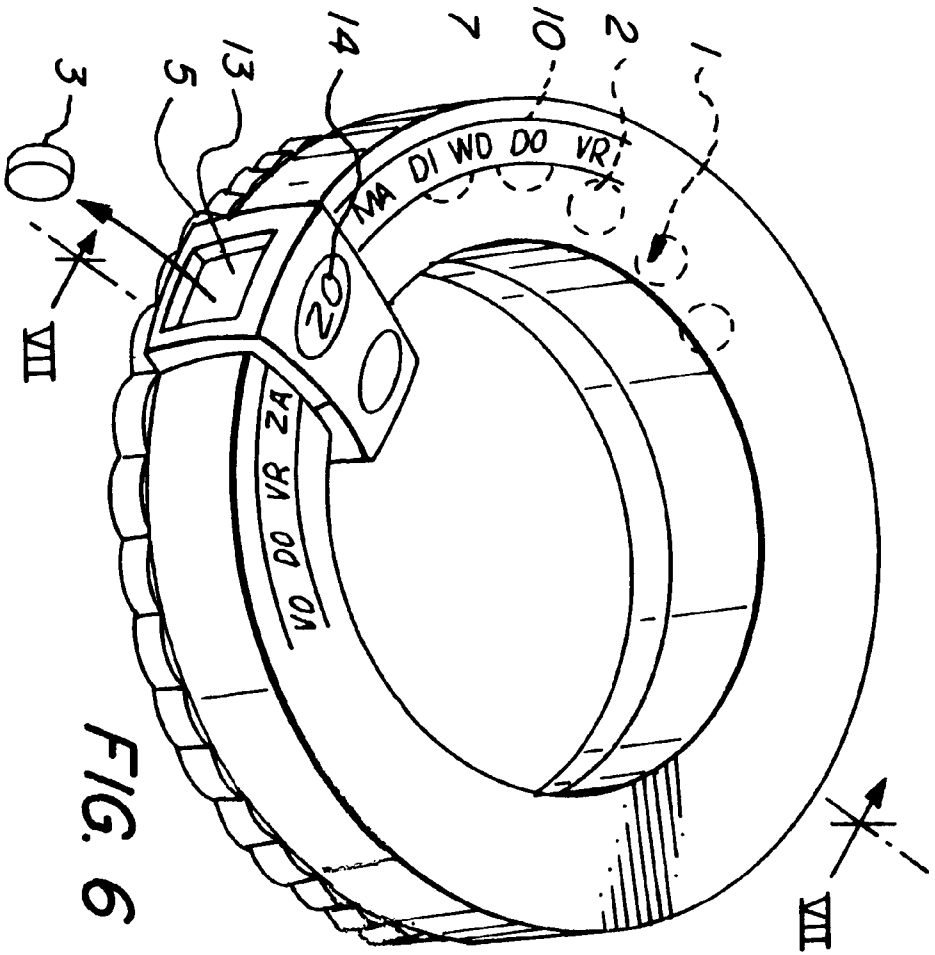
FIG. 6 is a perspective view of a third exemplary embodiment of the apparatus according to the invention.

FIGS. 5 and 6 show a second embodiment of the apparatus according to the invention, in which the push out means 14 is not radially slideable but is pivotable about an axis 22 extending parallel to the center line of the ring shaped lower and upper parts 5, 7. FIG. 5 shows a guide 23, 24 of the push out means 14, whereas the ramp 19 for the push out action is also clearly shown. The operation of this apparatus is principally similar to that of the embodiment of FIGS. 1–3 except for the slightly different movement of the push out means 14.

Figure 8:
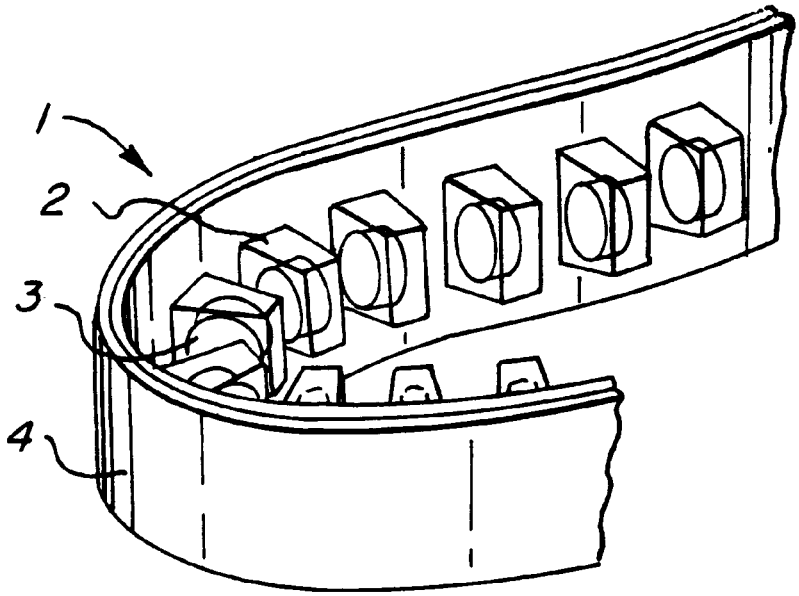
FIG. 8 shows in perspective a portion of the blister pack used in the apparatus according to FIG. 6 and 7.
Figure 7:
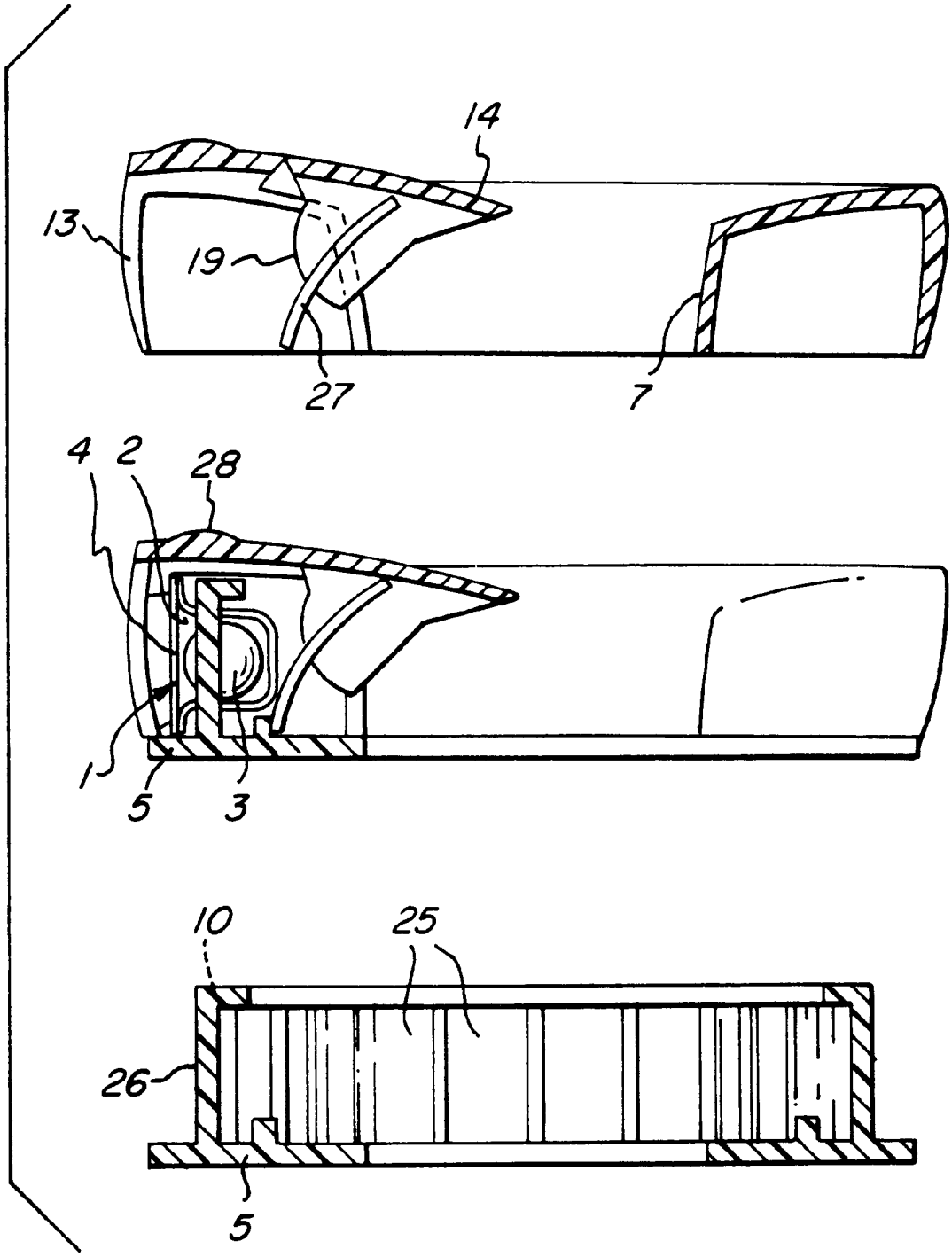
FIG. 7 is an enlarged sectional view along the line VII—VII in FIG. 6 whereas the separate upper and lower parts are shown below and above the assembly.

FIGS. 6, 7 and 8 show another embodiment of the apparatus according to the invention which is particularly intended to co-operate with the blister pack 1 shown in FIG. 8 which is longitudinal and substantially rectangular and in which the cavities 2 are distributed in a row extending lengthwise. The ring shape of this blister pack 1 is created by bending it such that the cavities 2 open outwardly and the pills 3 are allowed to be pushed out substantially radially outwardly. In this case the blister pack 1 is locked with respect to the lower part 5, since for each radially inwardly projecting cavity 2 of the blister pack 1, there is provided an opening 25 in a circumferencial wall 26 of the lower part 5, as is shown in FIG. 7. The lower part 5 is provided on the upper edge of the circumferencial wall 26 with the date indication 10 for each pill 3. In this case, the push out means 14 is pivotally connected to the upper part 7 and is constructed as a push button, and has a ramp 19 for pushing out the separate pills, in this case in a radially outward direction through the passage opening 13 also formed in the upper part 7. A spring element 27 urges the push out means 14 back to the inward starting position each time it has been operated. The upper side of the push out means 14 includes a magnifying glass 28 which is moved in line with the date indication 10 of the upper side of the circumferencial wall 26 of the lower part 5 each time, so that it can easily be read.

Figure 9:
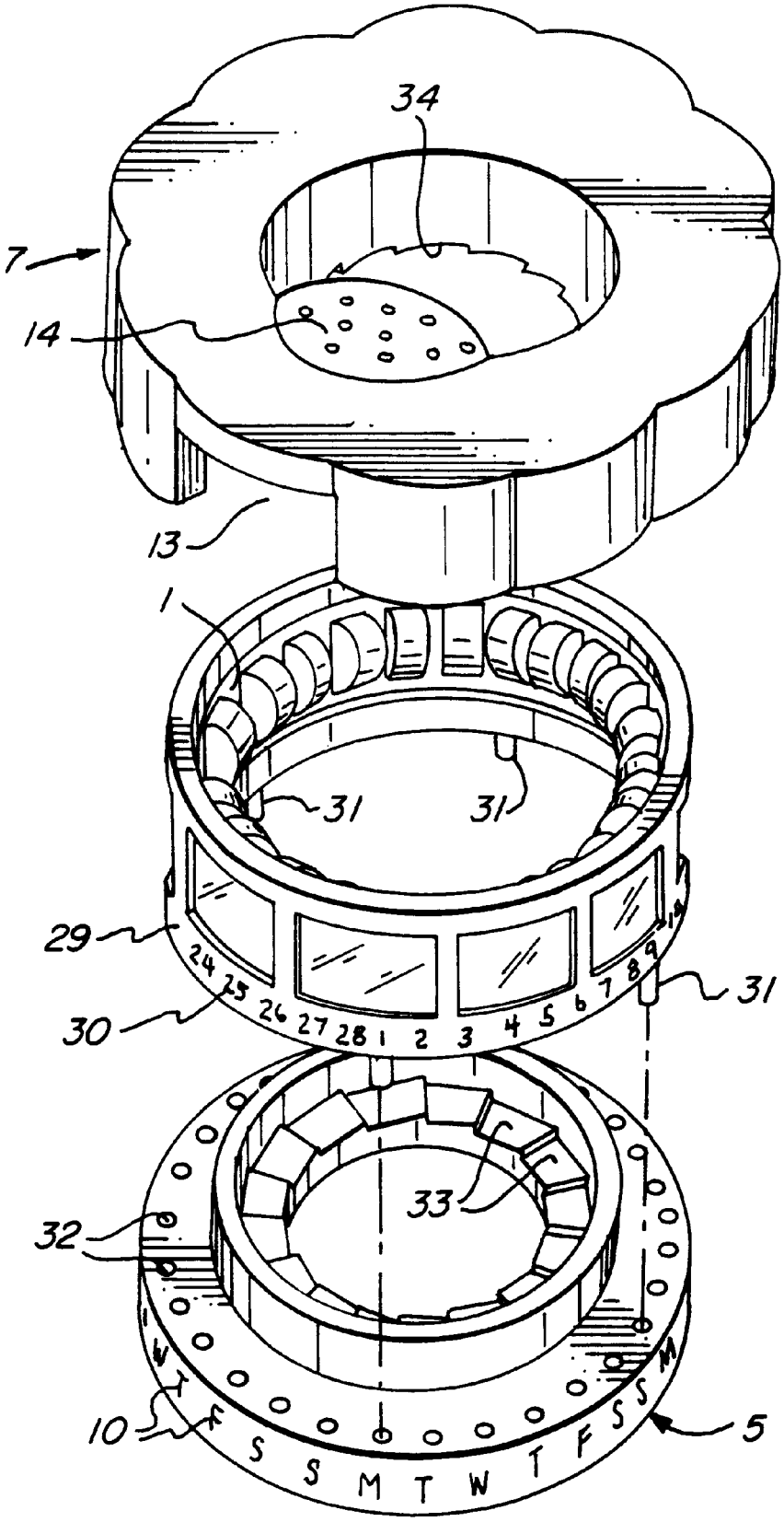
FIG. 9 is a perspective view of a fourth exemplary embodiment of the apparatus according to the invention.

FIG. 9 shows a further variant of the apparatus of FIG. 6–8, wherein the blister pack 1 is housed in a fixture 29 for holding the blister pack 1 in a ring shape. Preferably each blister pack 1 is supplied with such a fixture 29 and is already arranged in the fixture 29 by the manufacturer. This facilitates placing the blister pack 1 in the apparatus by the user. The fixture 29 may be provided with a numeral division 30 for the pills 3 and when the fixture 29 is placed on the lower part 5, number 1 should be positioned in line with the date indication belonging to the starting day of a particular cure. The lower side of the fixture 29 may comprise positioning members, such as pins 31 to be arranged in holes 32 in the lower part for locking the fixture and consequently the blister pack 1 with respect to the lower part 5. Toothings 33, 34, respectively on the lower and upper parts 5, 7 respectively, allow the rotation of parts 5, 7 in one direction only through one spacing between pills 3 of the blister pack 1 at a time. In case of an emergency, the fixture 29 and the blister pack 1 may also be used without the dispensing apparatus, in which case the pills should be pushed out by a finger and the numbering may be used for counting back to the starting day.

The invention is not restricted to the embodiments shown in the drawings and described herein before, which may be varied in different manners within the scope of the invention. In the first embodiment it would also be possible to lock the blister pack 1 relative to the lower part 5 in a rotationally fixed member and to allow the push out means 14 to rotate together with the upper part 7. In that case the lower part should include a number of passage openings 13 corresponding to the number of cavities 2 in the blister pack 1. Of course it would also be possible to push out more than one pill at a time, wherein the pills to be pushed out simultaneously should be positioned tangentially or radially adjacent. Instead of being equipped with a ramp, the push out means can also be moved in such a direction that the pill is pushed out by this movement. Also the design of the apparatus may be varied within wide boundaries. It is for example possible to partially or fully close the space internally of the substantially ring shaped lower and upper parts 5, 7, for example with creation of a room for the push out means and possibly with recesses for the rotational operation.

A further embodiment is conceivable in which the apparatus comprises a lower part, an upper lid part, connectable thereto in a rotationally fixed manner, and an outer part holding the blister pack and carrying along the pack upon rotation for aligning a new pill each time in front of the passage opening in the lower part.

In the embodiment including the fixture 29 for the blister pack 1, the blister pack may also be banana shaped in order to house the blister pack in the fixture in a conical or helical shape including one or more revolutions. The fixture may then also be slightly conical.

We claim:

1. A pocket dispenser for dispensing pills installed in a pill pack in which cavities containing pills are distributed, comprising:

a lower ring shaped part for supporting the pill pack in a ring shape, an upper ring shaped part fitting onto the lower part and surrounding the pill pack together with the lower part, said lower and upper parts interfitting with each other with relative rotational movement and forming a generally thin housing;

wherein at least one of said lower and upper parts have a passage opening through which a pill to be dispensed can be aligned, and push out means which can be positioned in radial alignment with the various pills in the pill pack and the passage opening for radially pushing out a pill to be dispensed through the passage opening;

a fixture having outwardly directed openings and containing a pre-mounted pill pack in a ring shaped position, with the openings in the fixture being in circumferential alignment with the cavities within the pill pack so as to enable an outward dispensing of pills held by the pill pack by the push out means.

2. The pocket dispenser for dispensing pills from a pill pack according to claim 1, wherein the push out means is positioned on a radially inner side of the ring shaped parts and is moveable along a radially outward direction for pushing out a pill through the passage opening.

3. A pocket dispenser for dispensing pills installed in a pill pack in which cavities containing pills are distributed, comprising:

a lower ring shaped part for supporting the pill pack in a ring shape, an upper ring shaped part fitting onto the lower part and surrounding the pill pack together with the lower part, said lower part and/or upper part having a passage opening through which a pill to be dispensed can be aligned, and push out means which can be positioned in radial alignment with the various pills in the pill pack and the passage opening for radially pushing out a pill to be dispensed through the passage opening;

a fixture having outwardly directed openings and containing a premounted pill pack in a ring shaped position, with the openings in the fixture being in circumferential alignment with the cavities within the pill pack so as to enable an outward dispensing of pills held by the pill pack by the push out means and wherein the fixture bears numbers respectively aligned with the cavities in the pill pack.

4. A pocket dispenser for dispensing pills installed in a pill pack in which cavities containing pills are distributed, comprising:

a lower ring shaped part for supporting the pill pack in a ring shape, an upper ring shaped part fitting onto the lower part and surrounding the pill pack together with the lower part, said lower part and/or upper part having a passage opening through which a pill to be dispensed can be aligned, and push out means which is positioned in radial alignment with the various pills in the pill pack and the passage opening for radially pushing out a pill to be dispensed through the passage opening;

a fixture having outwardly directed openings and containing a premounted pill pack in a ring shaped position, with the openings in the fixture being in circumferential alignment with the cavities within the pill pack so as to enable an outward dispensing of pills held by the pill pack by the push out means and wherein one of said parts bears a date indication and wherein the fixture is provided with positioning members to lock the fixture with its pill pack to the part of the dispensing apparatus bearing a date indication.

5. A pocket dispenser for dispensing pills installed in a pill pack in which cavities containing pills are distributed, comprising:

a lower ring shaped part for supporting the pill pack in a ring shape, an upper ring shaped part fitting onto the lower part and surrounding the pill pack together with the lower part, said lower part and/or upper part having a passage opening with which a pill to be dispensed can be aligned, and push out means which is positioned in radial alignment with the various pills in the pill pack and the passage opening for radially pushing out a pill to be dispensed through the passage opening;

a fixture having outwardly directed openings and containing a premounted pill pack in a ring shaped position, with the openings in the fixture being in circumferential alignment with the cavities within the pill pack so as to enable an outward dispensing of pills held by the pill pack by the push out means and wherein the push out means is connected to the upper part, and the lower part comprises means for locking the fixture with its pill pack in a rotationally fixed manner with respect to the lower part, and wherein the upper part is rotatably moveable relative to the lower part and has a passage opening for each pill to be simultaneously pushed out.

6. A portable pocket dispenser for dispensing pills from a pill pack having a row of cavities in which pills are distributed, comprising:

a fixture having a premounted pill pack, a lower part for supporting the fixture with its pill pack in a ring shape, an upper part fitting onto the lower part so as to form a relatively thin housing therewith and surrounding the pill pack and fixture together with the lower part, one of said parts including a passage opening with which a pill to be dispensed can be aligned, and push out means which is positioned in radial alignment with the various pills in the pill pack and the passage opening for pushing out a pill to be dispensed through the passage opening; wherein the lower and upper parts have a substantially ring shaped form and wherein the push out means is positioned on the inner side of the ring shaped pill pack and is moveable in a substantially radial direction relative to the parts for pushing out a said pill.

7. A portable pocket sized pill dispenser for dispensing pills from a pill pack in which pills in one row of cavities are distributed, comprising:

a fixture having a premounted pill pack, a lower part for supporting the pill pack in a ring shape, an upper part fitting onto the lower part and surrounding the pill pack together with the lower part and with rotational motion between said upper and lower parts around an axis and with the upper and lower parts forming a relatively thin housing as determined along the axis, said lower part and/or upper part including at least a passage opening with which a pill to be dispensed can be aligned, and push out means which can be positioned in alignment with respective pills in the pill pack and the passage opening for pushing out a pill to be dispensed through the passage opening;

wherein the push out means is positioned on an inner side of the ring shaped pill pack and is moveable in a substantially radial direction relative to the parts for a radially outward pushing action.

* * * * *